United States Patent [19]

Morse

[11] Patent Number: 4,615,297

[45] Date of Patent: Oct. 7, 1986

[54] POWDER REINFORCING MACHINE

[75] Inventor: Albert I. Morse, Beverly, Mass.

[73] Assignee: USM Corporation, Farmington, Conn.

[21] Appl. No.: 768,635

[22] Filed: Aug. 23, 1985

[51] Int. Cl.[4] ..... B05C 13/00

[52] U.S. Cl. ..... 118/503; 118/231; 269/238

[58] Field of Search ..... 269/238; 118/503, 231, 118/230, 319

[56] References Cited

U.S. PATENT DOCUMENTS 3,161,543 12/1964 Borders et al. ..... 118/503 X 4,502,411 3/1985 Gilbride et al. ..... 118/503

*Primary Examiner*—John P. McIntosh

*Attorney, Agent, or Firm*—Spencer T. Smith

[57] ABSTRACT

A powder reinforcing machine having a support for supporting a substrate which is to be reinforced with a fused powder laminate which is pressed thereagainst including a base, a mounting plate means on which the substrate is to be releasably clamped, the mounting plate being adapted to be displaced from a lower position to an upper position relative to the base means, and a pair of clamping lever arms which are to be displaced from a release position to a clamp position. The mounting plate displaces the clamping lever arms from the release position to the clamp position as it is displaced from the lower position to the upper position, and a pair of clamping rods each including a clamping portion, are secured to the clamping lever arms so that the clamping portion is spaced therefrom and will forcefully engage an associated clamping surface, which is defined by a recess extending along each side of the mounting plate, when the clamping lever arm is displaced to the clamp position.

3 Claims, 4 Drawing Figures

POWDER REINFORCING MACHINE

The present invention relates to powder reinforcing machines which deposit powder having a selected configuration, fuse the powder into a laminate and adhere the fused laminate to a substrate to reinforce the substrate.

In conventional powder reinforcing machines such as are disclosed in U.S. Pat. No. 4,503,091, the area and location of the substrate which may be reinforced is limited by clamping members which overlay the base plate substrate therebetween.

It is accordingly an object of the present invention to provide a powder reinforcing machine wherein the configuration of the laminate can be enlarged to extend into the area of the clamping members.

Other objects and advantages of the present invention will become apparent from the following portion of this specification and from the following drawings which illustrate, in accordance with the mandate of the patent statutes, a presently preferred embodiment of the invention.

Referring to the drawings.

Figure 1:
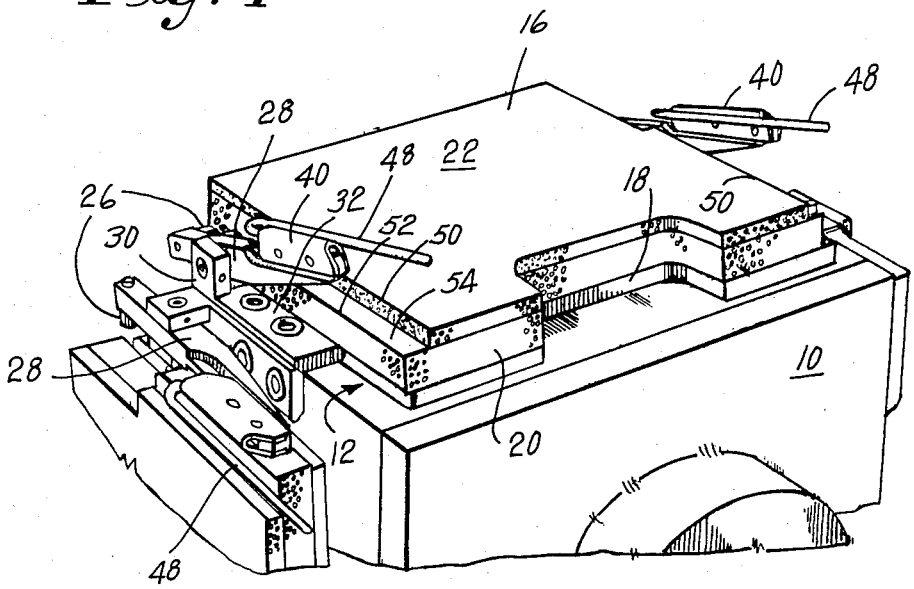
FIG. 1 is an oblique view of the top portion of the transfer cube of a powder reinforcing machine made in accordance with the teachings of the present invention.

The powder reinforcing machine utilizes a transfer cube 10 having four planar faces 12 which is mounted on a spindle (not shown) indexable to four 90° positions. The top or upper horizontal face 12 is the load/unload face to which a substrate 14 may be clamped in position on or removed from the transfer cube 10. The transfer cube 10 is vertically displaceable downwardly to lower the substrate 14 clamped to the lower horizontal face (not shown) into forced engagement with a fused powder laminate (also not shown) which adheres to the substrate to reinforce the substrate. Defining each of the four faces 12 of the transfer cube 10 is a mounting plate 16 which includes a metallic base plate 18 to which is secured by adhesive or the like a central layer 20 of relatively soft resilient material. A top layer 22 of firmer resilient material is secured to the top of the central layer 20.

Figure 2:
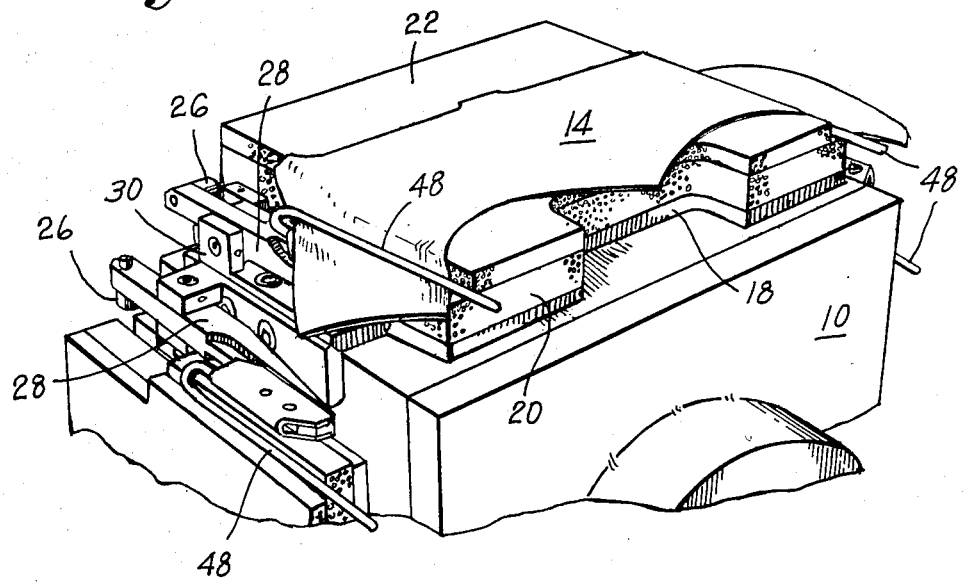
FIG. 2 is a view similar to that of FIG. 1 with a substrate clamped in position on the transfer cube.
Figure 4:
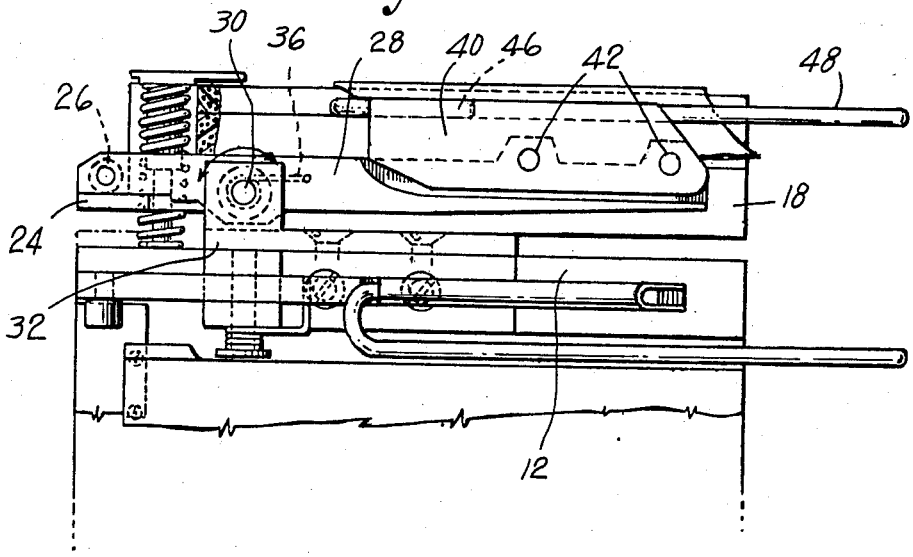
FIG. 4 is a side elevational view of the left hand side of the transfer cube illustrated in FIG. 2.

The base plate 18 is mounted for displacement relative to the spindle from a lowered position (FIG. 1) to an elevated position (FIG. 2). Extending horizontally from either side of the base plate 18 are a pair of tabs 24 (FIG. 4). Each tab 24 engages a wheel 26 rotatably mounted on the rearward end of a clamping lever 28 which is pivotally mounted on the post 30 of a bracket 32 secured to the transfer cube face 12. A spring 36 extending between the bracket 32 and the clamping lever 28 permanently biases each wheel against its associated tab 24. Displacement of the mounting plate 16 from the lower position to the upper position accordingly controls the movement of the clamping levers 28 from a release position illustrated in FIG. 1 to a clamping position shown in FIGS. 2 and 4.

Figure 3:
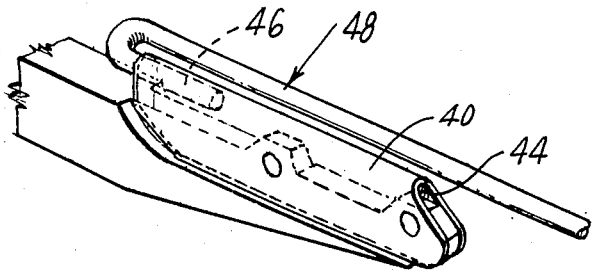
FIG. 3 is an oblique view of a portion of the left hand clamp shown in FIGS. 1 and 2.

A clamping bracket 40 is secured to the forward end of each clamping lever 28 by suitable fasteners 42 . The clamping bracket 40, which is basically U-shaped in cross-section, presents a channel 44 into which the short leg 46 of a J-shaped clamping rod 48 can be located and permanently secured by induction brazing or the like. As can be seen from FIG. 3, the clamping rod 48 extends parallel to and is spaced from the clamping bracket 40.

The side edges 50 of the top layer 22 are set back from the side edges 52 of the central layer 20 thereby defining linear, flat, resilient clamping surfaces 54 against which the clamping rods 48 will be forcefully located when the mounting plate 16 is raised to its elevated position. The central layer is sufficiently resilient to accommodate the clamping of substrates 14 of differing thicknesses. With the base plate 18 lowered and the clamp rods 48 raised, a substrate 14 can be readily removed from or placed in position over the mounting plate 16 by passing each side of the substrate 14 under the clamping rods 48, between the clamping rods 48 and the clamping brackets 40 and over the clamping brackets 40.

What is claimed is:

1. A powder reinforcing machine comprising substrate supporting means for supporting a substrate which is to be reinforced with a selectively configured fused powder laminate which is pressed thereagainst including, base means, mounting plate means on which the substrate is to be releasably clamped, said mounting plate means being adapted to be displaced from a lower position to an upper position relative to said base means, a pair of clamping lever arms, means for mounting one of said pair of clamping lever arms on either side of said mounting plate means for displacement from a release position to a clamp position, said mounting plate means including means for displacing each of said clamping lever arms from said release position to said clamp position as said mounting plate means is displaced from said lower position to said upper position, and a recess defining a clamping surface extending along each side thereof, a pair of clamping rods each including a clamping portion, means for securing one of said clamping rods to each of said clamping lever arms so that said clamping portion is spaced therefrom and will forcefully engage its associated clamping surface when said clamping lever arm is displaced to said clamp position.

2. A powder reinforcing machine according to claim 1, wherein said clamping surface is resilient.

3. A powder reinforcing machine according to claim 2, wherein said clamping rods have a "J"-shape with the short leg thereof secured to said clamping lever arm.

* * * * *